US007388355B2

(12) United States Patent
Ikeda

(10) Patent No.: US 7,388,355 B2
(45) Date of Patent: Jun. 17, 2008

(54) VOLTAGE REGULATOR

(75) Inventor: Junichi Ikeda, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/711,751

(22) Filed: Feb. 28, 2007

(65) Prior Publication Data

US 2008/0001588 A1 Jan. 3, 2008

(30) Foreign Application Priority Data

Jun. 30, 2006 (JP) ..... 2006-180977

(51) Int. Cl.
*G05F 1/40* (2006.01)

(52) U.S. Cl. ..... 323/271

(58) Field of Classification Search ..... 323/265, 323/271, 282, 285, 351; 327/538, 540, 541
See application file for complete search history.

(56) References Cited

U.S. PATENT DOCUMENTS 5,751,142 A * 5/1998 Dosho et al. ..... 323/316
6,534,963 B2 * 3/2003 Bayer et al. ..... 323/313
6,977,488 B1 * 12/2005 Nogawa et al. ..... 323/271
7,224,208 B2 * 5/2007 Matsushita ..... 327/538

FOREIGN PATENT DOCUMENTS

JP 2002-091575 3/2002

* cited by examiner

*Primary Examiner*—Adolf Berhane
(74) *Attorney, Agent, or Firm*—Volentine & Whitt, PLLC

(57) ABSTRACT

When the control signal EN is changed to "H", a reference voltage VR is generated by a reference voltage generator 10, and a bias voltage BL is generated by the bias circuit 20. Based on the reference voltage VR and the bias voltage BL, a differential amplifier 30 and an output circuit 40 generates an output voltage VA. A delay circuit 50 outputs a delayed signal DL a certain delay time after the control signal EN riese. A switching signal SW used for control over the first switch 5 is made High when the control signal EN and the delayed signal DL are both High. Accordingly, it is possible to switch the voltage at the output node NO, after the output voltage VA is stabilized.

3 Claims, 4 Drawing Sheets

VOLTAGE REGULATOR

BACKGROUND OF THE INVENTION

The present invention relates to a voltage regulator for outputting a constant voltage, and in particular to stabilization of the output voltage at the time of switching.

FIG. 2 shows a conventional voltage regulator.

The illustrated voltage regulator is for supplying a display drive voltage VD to a boosting circuit 2 generating a boosted voltage VP to be supplied to a display panel 1, and comprises a first voltage generating circuit 4 for generating a first output voltage VA, and a second voltage generating circuit 3 for generating a second output voltage VB. The first voltage generating circuit 4 comprises a reference voltage generator 10, a bias circuit 20, a differential amplifier 30, and an output circuit 40.

The output terminal of the output circuit 40 is connected via a first switch 5 to an output node NO. The output terminal of the second voltage generating circuit 3 is connected via a second switch 6 to the output node NO. The first switch 5 is controlled by a control signal EN, while the second switch 6 is controlled by an inverted control signal /EN obtained by inverting the control signal EN by an inverter 7.

The reference voltage generator 10 generates and outputs a reference voltage VR when it is permitted to operate (or activated) by the control signal EN. The bias circuit 20 outputs a bias voltage BL to the differential amplifier 30 and the output circuit 40 when it is permitted to operate (activated) by the control signal EN. The bias voltage BL is for causing a predetermined current to flow through the differential amplifier 30, and for causing a predetermined current to flow through the output circuit 40.

The differential amplifier 30 amplifies the difference between the reference voltage VR supplied from the reference voltage generator 10, and the output voltage VA of the output circuit 40, and controls the output circuit 40, so that the output voltage VA becomes equal to the reference voltage VR. The differential amplifier 30 comprises N-channel MOS transistors (hereinafter referred to as "NMOS") 31 and 32 with their gates supplied with the reference voltage VR and the output voltage VA, respectively. The sources of the NMOS's 31 and 32 are connected to the ground potential node GND via an NMOS 33 controlled by the bias voltage BL. The drains of the NMOS's 31 and 32 are connected to the nodes N31 and N32, respectively.

The nodes N31 and N32 are connected to the power supply potential node VDD via P-channel MOS transistors (hereinafter referred to as "PMOS") 34 and 35, respectively. The gates of the PMOS 34 and 35 are connected to the node N32.

The output circuit 40 has a PMOS 41 connected between a node N41 at which the output voltage VA appears, and the power supply potential node VDD, and having its gate connected to the node N31, and an NMOS 42 connected between the node N41 and the ground potential node GND, and having its gate supplied with the bias voltage BL. The node N41 and the node N31 are coupled by a series connection of a resistor 43 and a capacitor 44 for phase compensation.

In the voltage regulator shown in FIG. 2, when the control signal EN is at a level "L" (ground potential GND), the reference voltage generator 10 and the bias circuit 20 are prohibited to operate (or deactivate) and the reference voltage VR from the reference voltage generator 10 is at "L", and the bias voltage BL output from the bias circuit 20 is set to "L". The NMOS's 33 and 42 are OFF, and the differential amplifier 30 and the output circuit 40 are also prohibited to operate. Moreover, the control signal EN at "L" will cause the first switch 5 to be OFF, and the second switch 6 to be ON. The output voltage VB from the second voltage generating circuit 3 is supplied via the second switch 6 to the output node NO, as a drive voltage VD.

When the control signal EN is at a level "H" (power supply potential VDD), the reference voltage generator 10 and the bias circuit 20 operate (are activated), and the bias voltage BL output from the bias circuit 20 causes the differential amplifier 30 and the output circuit 40 to operate (to be activated). Moreover, when the control signal EN is at "H", the first switch 5 is ON, and the second switch 6 is OFF. As a result, the output voltage VA from the output circuit 40 is supplied via the first switch 5 to the output node NO, as the drive voltage VD.

Another circuit for generating a constant voltage, with a switching circuit for switching between an external normal power supply and a backup power supply, is shown in Japanese Patent Kokai Publication No. 2002-91575.

The above-described voltage regulator has the following problems. When the control signal EN is changed from "L" to "H", the first and second switches 5 and 6 respond promptly, and the first switch 5 is turned ON and the second switch 6 is turned OFF. As a result, the output voltage VB which has been output from the second voltage generating circuit 3 to the output node NO is promptly interrupted. On the other hand, the output voltage VA output from the output circuit 40 will not be at a normal voltage until the operation of the reference voltage generator 10, the bias circuit 20 and the differential amplifier 30 is stabilized. As a result, the voltage at the output node NO is unstable, immediately after the switching, and the display quality of the display panel 1 is lowered.

SUMMARY OF THE INVENTION

An object of the present invention is to provide a voltage regulator which can output a stable voltage when the output voltage is switched.

According to the present invention, there is provided a voltage regulator comprising:

a first voltage generating circuit for generating a first output voltage;

a second voltage generating circuit for generating a second output voltage;

a switch circuit for outputting either the first output voltage or the second output voltage to an output node; and a delay circuit for generating a delayed signal, by delaying a control signal designating the first output voltage or the second output voltage;

said first voltage generating circuit being responsive to the control signal, for generating a bias voltage for controlling the operation, and generating the first output voltage corresponding to a reference voltage, based on the reference voltage and the bias voltage, when the first output voltage is designated by the control signal;

said delay circuit having its delay operation controlled by the bias voltage; and said switch circuit outputting the first output voltage generated by the first voltage generating circuit to the output node, when the first output voltage is designated by the control signal, and the first output voltage is designated by the delayed signal, and outputting the second output voltage generated by the second voltage generating circuit to the output node, at other times.

According to the invention, the delay circuit produces the delayed signal having a delay time corresponding to the operation speed of the first voltage generating circuit, and the delayed signal is used to switch, by means of the switch circuit, between the first and second voltages. As a result, a stable output voltage can be produced when the output voltage is switched.

DETAILED DESCRIPTION OF THE INVENTION

The invention will be more apparent from the following description of the preferred embodiments taken in conjunction with the attached drawings. However, the drawings are only for showing the examples, and should not be taken as limiting the invention.

Embodiment 1

Figure 1:
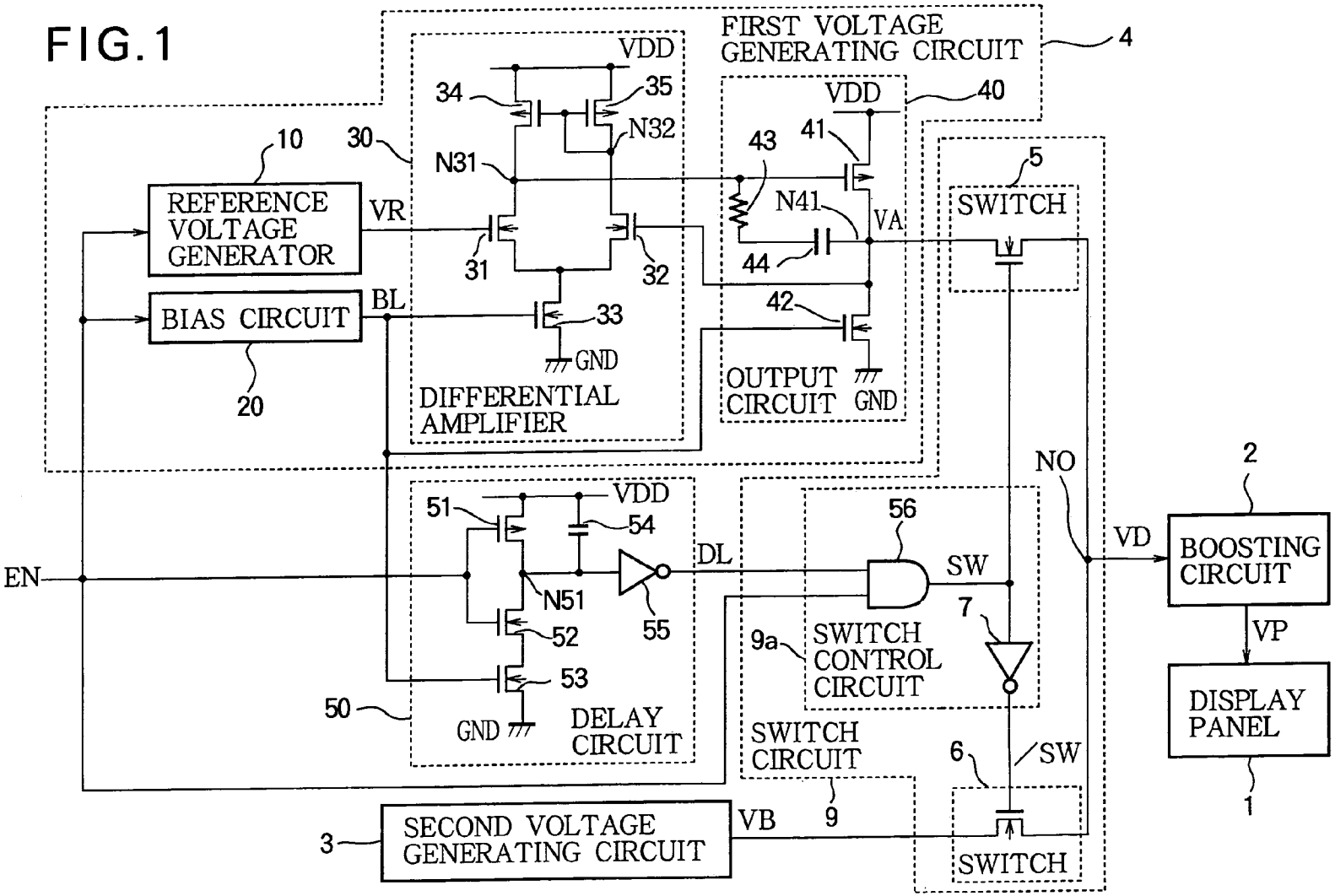
FIG. 1 is a circuit diagram showing a voltage regulator of Embodiment 1 of the present invention.
Figure 2:
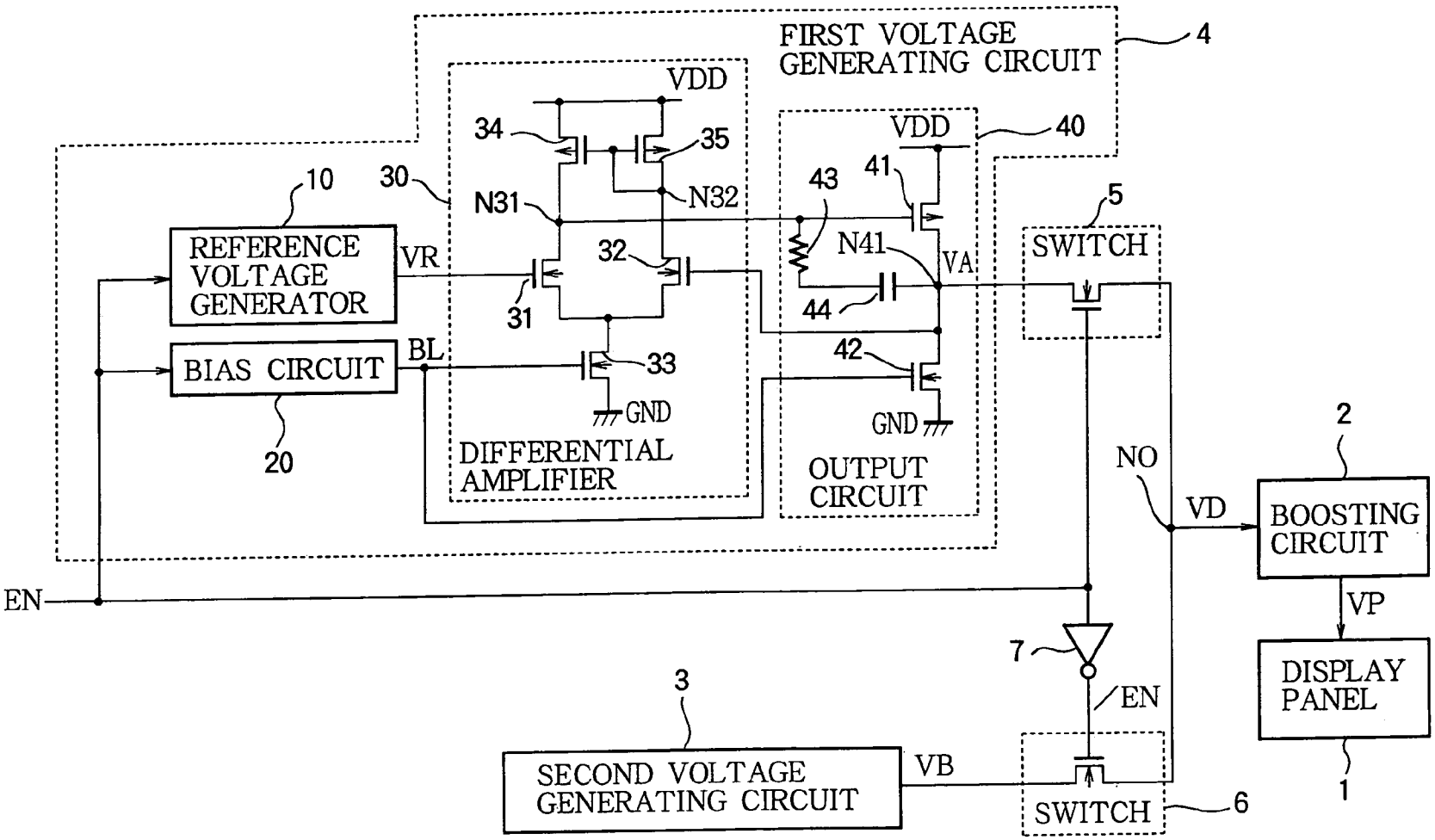
FIG.2 CONVENTIONAL ART
FIG. 2 is a circuit diagram showing a conventional voltage regulator.
Figures 3A, 3B, 3C, 3D, 3E:
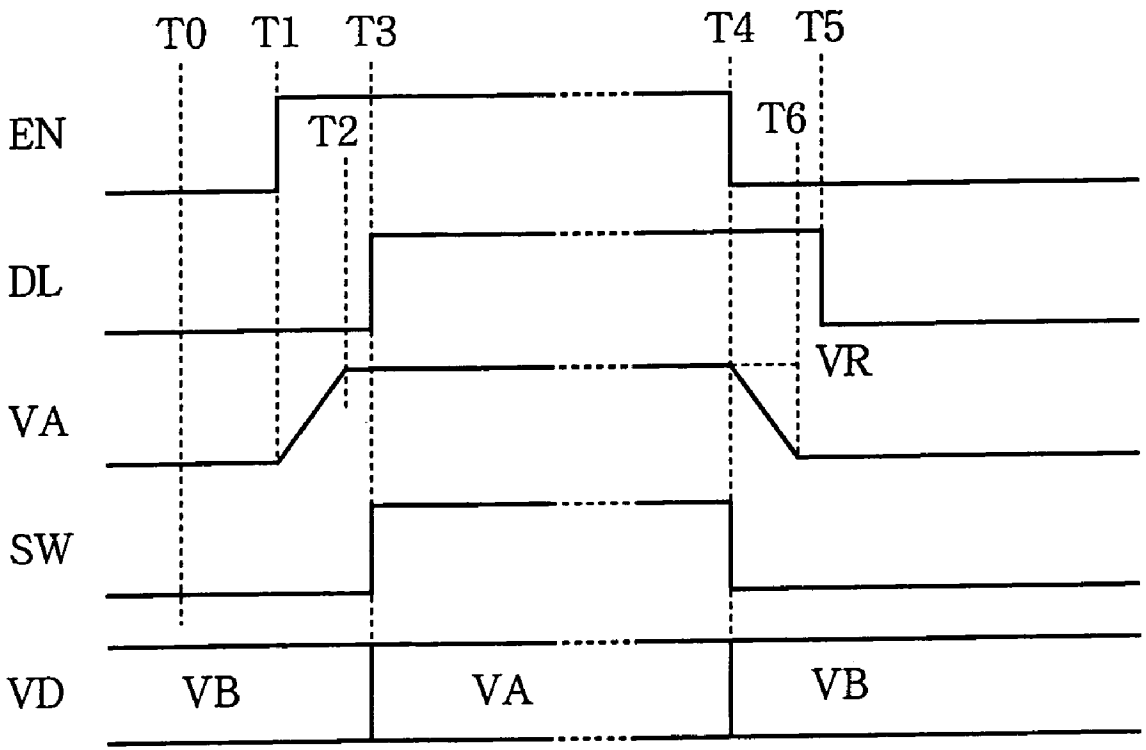
FIGS. 3A to 3E are waveform diagrams showing the signals at various node in the circuit of FIG. 1.

FIG. 1 shows a voltage regulator of Embodiment 1 of the present invention. Members and elements similar to those in FIG. 2 are denoted by identical reference characters.

The voltage regulator is for supplying a display drive voltage VD to a boosting circuit 2 generating a boosted voltage VP to a display panel 1, and comprise a first voltage generating circuit 4 generating a first output voltage VA, a second voltage generating circuit 3 generating a second output voltage VB, and a switch circuit 9 outputting the first output voltage VA or the second output voltage VB to the output node NO.

The first voltage generating circuit 4 comprises a reference voltage generator 10, a bias circuit 20, a differential amplifier 30, and an output circuit 40.

The illustrated voltage regulator also comprises a delay circuit 50 for controlling the timing at which the switching between the output voltages VA and VB takes place.

The switch circuit 9 comprises a first switch 5, a second switch 6, and a switch control circuit 9*a* for controlling the conduction state of the first and second switches 5 and 6.

In the illustrate embodiment, the switch control circuit 9*a* comprises a logical product gate (hereinafter referred to "AND gate") 56 and an inverter 7.

The output terminal of the second voltage generating circuit 3 is connected via the second switch 6 to the output node NO. Thus, the second switch 6 supplies the second output voltage VB to the output node NO when the second switch 6 is ON. The output terminal of the output circuit 40 is connected via the first switch 5 to the output node NO. Thus, the first switch 5 supplies the first output voltage VA to the output node NO when the first switch 5 is ON. The first switch 5 is controlled by a switching signal SW output from the AND gate 56, while the second switch 6 is controlled by an inverted switching signal /SW obtained by inverting the switching signal SW by the inverter 7.

The reference voltage generator 10 generates and outputs a reference voltage VR when it is permitted to operate (or activated) by the control signal EN. The bias circuit 20 outputs a bias voltage BL to the differential amplifier 30 and the output circuit 40 when it is permitted to operate by the control signal EN. The bias voltage BL is for causing a predetermined current to flow through the differential amplifier 30, and for causing a predetermined current to flow through the output circuit 40.

The differential amplifier 30 amplifies the difference between the reference voltage VR supplied from the reference voltage generator 10 and the output voltage VA of the output circuit 40, and uses the difference to control the output circuit 40, so that the output voltage VA becomes equal to the reference voltage VR. The differential amplifier 30 has NMOS's 31 and 32 supplied with the reference voltage VR and the output voltage VA, respectively at their gates. The sources of the NMOS's 31 and 32 are connected to the ground potential node GND, via the NMOS 33 which is controlled by the bias voltage BL. The drains of the NMOS's 31 and 32 are connected to the nodes N31 and N32, respectively, and the nodes N31 and N32 are connected via the PMOS's 34 and 35, respectively, to the power supply potential node VDD. The gates of the PMOS's 34 and 35 are connected to the node N32.

The output circuit 40 comprises a PMOS 41 and an NMOS 42. The PMOS 41 is connected between the node N41 at which the output voltage VA appears, and the power supply potential node VDD. Specifically, the PMOS 41 has its first main electrode, e.g., the source, connected to the power supply potential node VDD, and has its second main electrode, e.g, the drain, connected to the node N41. The gate of the PMOS 41 is connected to the node N31. The NMOS 42 is connected between the node N41 and the ground potential node GND. Specifically, the NMOS 42 has its first main electrode, e.g., the drain, connected to the node N41, and has its second main electrode, e.g, the source, connected to the ground potential node GND. The gate of the NMOS 42 is supplied with the bias voltage BL. Connected between the node N41 and the node N31 is a series connection of a resistor 43 and a capacitor 44 for phase compensation.

The delay circuit 50 comprises a PMOS 51 connected between the power supply potential node VDD and a node N51, and NMOS's 52 and 53 connected in series with each other, and between the node N51 and the ground potential node GND. Specifically, the PMOS 51 has its first main electrode, e.g., the source, connected to the power supply potential node VDD, and has its second main electrode, e.g., the drain, connected to the node N51. The NMOS 52 has its first main electrodes, e.g., the drain, connected to the node N51, while the NMOS 53 has its first main electrodes, e.g., the drain, connected to the second main electrode, e.g., the source, of the NMOS 52. The second main electrode, e.g., the source, of the NMOS 53 is connected to the ground potential node GND.

The PMOS 51 and the NMOS 52 in combination form an inverter, and are supplied with the control voltage EN at their gates. The NMOS 53 is supplied, at its gate, with the bias voltage BL from the bias circuit 20, as is the differential amplifier 30 and the output circuit 40.

The node N51 is connected via a capacitor 54 to the power supply potential node VDD. The node N51 is also connected to the input terminal of the inverter 55. A delayed signal DL is output from the output terminal of the inverter 55, and the AND gate 56 produces the logical product of the delayed signal DL and the control signal EN, as the switching signal SW.

When the control signal EN is at "H", it is said to be "designating" the first output voltage VA (or asserting the first output voltage VA is to be selected and output), while when the control signal EN is at "L", it is said to be designating the second output voltage VB (or asserting the second output voltage VB is to be selected and output). Similarly, when the delayed signal DL is at "H", it is said to be designating the first output voltage VA, while when the delayed signal DL is at "L", it is said to be designating the second output voltage VB. The switch control circuit 9*a* formed of the AND gate 56 and the inverter 7 causes the first switch 5 to be ON when both of the control signal EN and the delayed signal DL are at "H", or, in other words, the first output voltage VA is designated by the control signal EN, and the first output voltage VA is designated by the delayed signal DL.

FIGS. 3A to 3E are waveform diagrams showing the signals appearing at various parts in the circuit of FIG. 1. The operation of FIG. 1 will next be described with reference to FIGS. 3A to 3E.

If, at time T0 in FIG. 3, the control signal EN is at "L" for designating the second output voltage VB, the reference voltage generator 10 and the bias circuit 20 are prohibited to operate (or deactivated), and the bias voltage VL from the bias circuit 20 is also at "L". As a result, the NMOS's 33 and 42 are OFF, and the differential amplifier 30 and the output circuit 40 are prohibited to operate. In addition, in the delay circuit 50, the control signal EN at "L" causes the PMOS 51 to be ON, and the NMOS 52 to be OFF, and the bias voltage BL at "L" causes the NMOS 53 to be OFF. As a result, the node N51 is at "H", the delayed signal DL output from the inverter 55 is at "L". Furthermore, the switching signal SW output from the AND gate 56 is at "L", the first and second switches 5 and 6 in the form of NMOS's are OFF and ON, respectively. As a result, the output voltage VB from the second voltage generating circuit 3 is output via the second switch 6 to the output node NO, as a drive voltage VD.

If, at time T1, the control signal EN is changed to "H" for designating the first output voltage VA, the reference voltage generator 10 and the bias circuit 20 start to operate (are activated), and the bias voltage BL from the bias circuit 20 causes the differential amplifier 30, the output circuit 40, and the delay circuit 50 to start to operate (to be activated).

In the differential amplifier 30 and the output circuit 40, the output voltage VA at the node N41 rises by the feed-back operation, and reaches the target reference voltage VR at time T2. In the delay circuit 50, the delayed signal DL becomes "H" at time T3, a certain time (delay time) after the time T1, due to the time for charging the capacitor 54. The time T3 is made to coincide with or a little after the time T2. When the delayed signal DL becomes "H" (at time T3) for designating the first output voltage VA, the switching signal SW is changed to "H", and the first switch 5 is changed to ON, while the second switch 6 is changed to OFF, and the output voltage VA from the output circuit 40 is supplied via the first switch 5 to the output node NO, as the drive voltage VD.

If, at time T4, the control signal EN is changed to "L", the switching signal SW is changed to "L", and the first switch 5 is changed to OFF, while the second switch 6 is changed to ON. As a result, the output voltage VB from the second voltage generating circuit 3 is supplied via the second switch 6 to the output node NO, as the drive voltage VD. The reference voltage generator 10 and the bias circuit 20 are stopped to operate (are deactivated), and the bias voltage BL from the bias circuit 20 is changed to "L". As a result, the NMOS's 33 and 42 are turned OFF, and the differential amplifier 30 and the output circuit 40 are stopped to operate, and the output voltage VA from the output circuit 40 is lowered.

In the delay circuit 50, the delayed signal DL is changed to "L" at time T5, a certain time (delay time) after the time T4, due to the time for discharging the capacitor 54. The time T5 coincides or is little after the time T6 at which the output voltage VA falls to the ground potential GND. However, at this time point, the switching signal SW is already at "L", so that the states of the first and second switches 5 and 6 are not changed.

As has been described, the voltage regulator of Embodiment 1 has the delay circuit 50 which causes the switching signal SW which is changed to "H" a certain delay time after the control signal EN is changed to "H", and is changed to "L" without delay when the control signal EN is changed to "L". As a result, when the control signal EN is changed to "H", the first and second switches 5 and 6 are switched after the output voltage VA of the output circuit 40 reaches the reference voltage VR, and is stabilized, when, on the other hand, the control signal EN is changed to "L", the first and second switches 5 and 6 are switched instantly. As a result, it is possible to prevent the output voltage VA from appearing as the drive voltage VD while the output voltage VA is unstable (i.e., before the output voltage is stabilized), and it is ensured that the stable voltage is output when the output voltage is switched.

Moreover, the delay circuit 50 includes an NMOS 53 which is in series with the PMOS 51 and the NMOS 52 forming the inverter for inverting the control voltage EN, and the conduction state of the NMOS 53 is controlled by the bias voltage BL, which is also supplied to the differential amplifier 30 and the output circuit 40. As a result, the time taken for the differential amplifier 30 and the output circuit 40 are stabilized after they are activated, and the delay time of the switching signal SW by the delay circuit 50 can be made to be approximately equal.

That is, if the bias voltage BL is set high, the currents flowing through the differential amplifier 30 and the output circuit 40 become larger, and the response speed becomes higher, and a desired output voltage VA can be obtained in a short time. The current flowing through the NMOS 53 in the delay circuit 50 is also increased, and the time for charging the capacitor 54 is also shortened, and the delay time of the delay circuit 50 is also shortened. As a result, the delay time of the delay circuit 50 needs not be longer than necessary (the delay time needs not have a margin), and it is possible to carry out the switching to a stable, desired output voltage in a short time.

Embodiment 2

Figure 4:
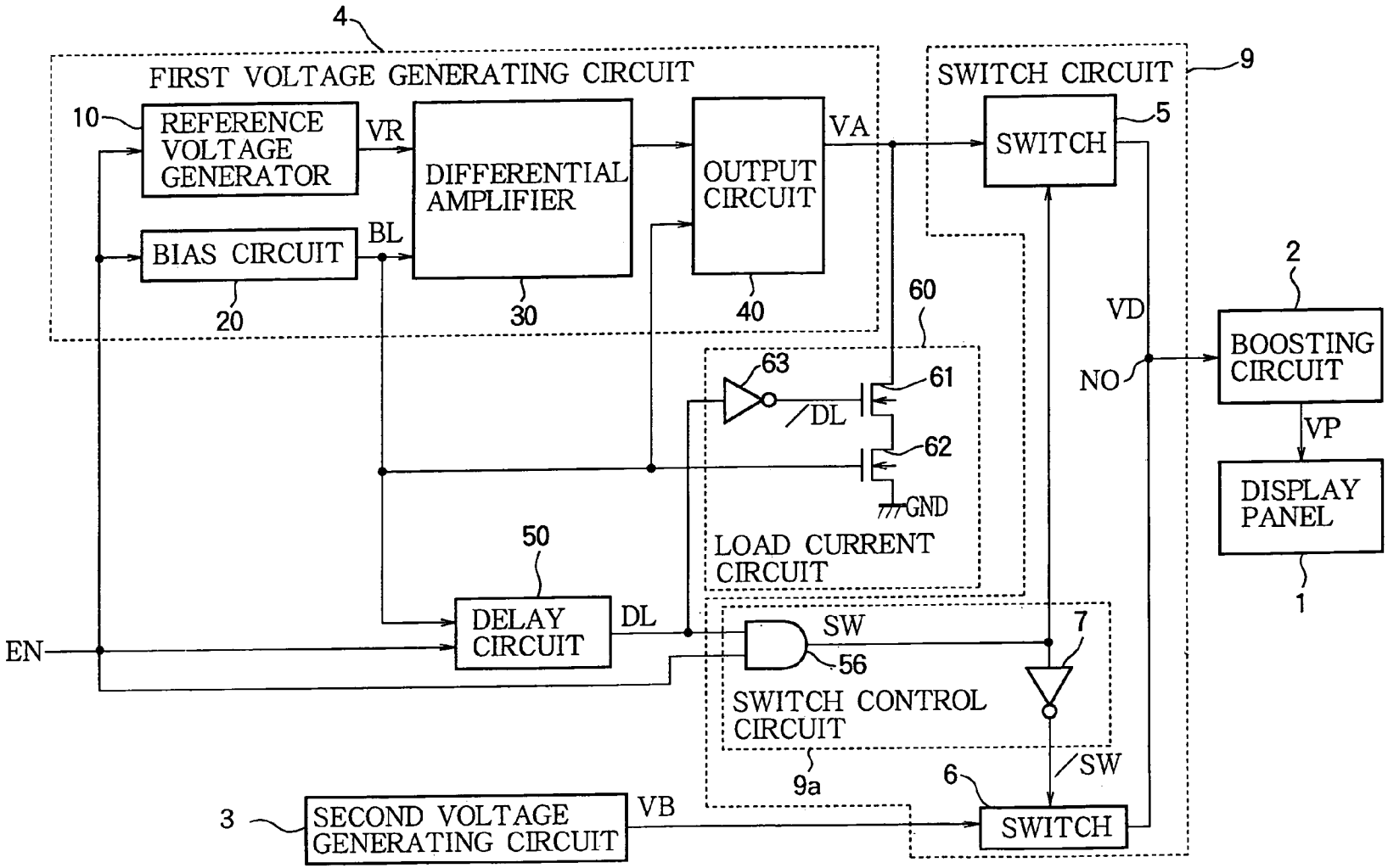
FIG. 4 is a circuit diagram showing the voltage regulator of Embodiment 2 of the present invention.

FIG. 4 shows a voltage regulator of Embodiment 2 of the present invention. Member and elements similar to those in FIG. 1 are denoted by identical reference characters.

The voltage regulator shown in FIG. 4 is identical to that shown in FIG. 1, but a load current circuit 60 is inserted between the output terminal of the output circuit 40 and the ground potential node GND.

The load current circuit 60 permits a load current from the output circuit 40 to flow therethrough, after the control signal EN is changed from "L" to "H" and until the delayed signal DL is changed from "L" to "H". The load current circuit 60 comprises NMOS's 61 and 62 connected in series with each other and between the output terminal of the output circuit 40 and the ground potential node GND. Specifically, the NMOS 61 has its first main electrode, e.g., the drain connected to the output terminal of the output circuit 40, and the NMOS 62 has its first main electrode, e.g., the drain, connected to the second main electrode, e.g., the source, of the NMOS 61. The second main electrode, e.g., the source, of the NMOS 62 is connected to the ground potential node GND. Supplied to the gate of the NMOS 61 is an inverted delayed signal /DL obtained by inverting the delayed signal DL by the inverter 63, and supplied to the gate of the NMOS 62 is the bias voltage BL. The rest of the configuration is identical to that of FIG. 1.

In the voltage regulator, when the control signal EN is at "L", the bias voltage BL is at "L", so that the NMOS 62 in the load current circuit 60 is OFF. After the control signal EN is changed from "L" to "H", and until the delayed signal DL is changed from "L" to "H", the gate of the NMOS 61 is supplied with "H" from the inverter 63, and the bias voltage BL (at a high level) is supplied to the gate of the NMOS 62. During such a period, the first switch 5 is OFF, so that a load current flows from the output terminal of the output circuit 40, via the load current circuit 60, to the ground potential node GND.

When the delayed signal DL is later changed to "H", then the NMOS 61 in the load current circuit 60 is turned OFF, and the first switch 5 is turned ON, so that the current flowing through the load current circuit 60 is stopped, and the current from the output circuit 40 flows through the first switch 5 to the boosting circuit 2. The rest of the operation is identical to that described in connection with Embodiment 1.

As has been described, the voltage regulator of Embodiment 2 is provided with the load current circuit 60 for permitting the load current from the output circuit 40 to flow. As a result, in addition to the merits of Embodiment 1, it has an additional merit that the phase margin at the time of no load state can be improved.

The invention is not limited to the embodiments described above, but various modifications are possible, as exemplified below.

(a) The invention has been described as a voltage regulator which outputs a drive voltage VD for a display panel, but the invention is not limited with regard to the intended use of the voltage regulator, and the invention is applicable to any voltage regulator which switches between and outputs two or more voltages.

(b) The configurations of the differential amplifier 30, the output circuit 40, and the delay circuit 50 are not limited to those shown in FIG. 1.

(c) The load current circuit 60 is not limited to that shown in FIG. 4.

(d) In the illustrated embodiments, when the control signal EN is at "H" it designates the first output voltage VA. But the particular level of the signals for designating the first output voltage VA is not essential. It may be so arranged that the first output voltage VA is designated when the control signal EN is at "L". Similarly, it may be so arranged that the first output voltage VA is designated by the delayed signal DL when the delayed signal DL is at "L", rather at "H" as in the embodiments described.

What is claimed is:

1. A voltage regulator comprising:

a first voltage generating circuit for generating a first output voltage;

a second voltage generating circuit for generating a second output voltage;

a switch circuit for outputting either the first output voltage or the second output voltage to an output node; and a delay circuit for generating a delayed signal, by delaying a control signal designating the first output voltage or the second output voltage;

said first voltage generating circuit being responsive to the control signal, for generating a bias voltage for controlling the operation, and generating the first output voltage corresponding to a reference voltage, based on the reference voltage and the bias voltage, when the first output voltage is designated by the control signal;

said delay circuit having its delay operation controlled by the bias voltage; and said switch circuit outputting the first output voltage generated by the first voltage generating circuit to the output node, when the first output voltage is designated by the control signal, and the first output voltage is designated by the delayed signal, and outputting the second output voltage generated by the second voltage generating circuit to the output node, at other times.

2. The voltage regulator as set forth in claim 1, wherein said switch circuit comprises a first switch for supplying the first output voltage to the output node when said first switch is ON, and a second switch for supplying the second output voltage to the output node when said second switch is ON, and a switch control circuit causing said first switch to be ON when the first output voltage is designated by the control signal, and the first output voltage is designated by the delayed signal, and causing said second switch to be ON at other times.

3. The voltage regulator as set forth in claim 1, further comprising a load current circuit connected to the output terminal of the first voltage generating circuit, and permitting a load current from the first voltage generating circuit to flow after the first output voltage is designated by the control signal, and until the first output voltage is designated by the delayed signal.

* * * * *